US010575574B1

(12) United States Patent
Toledo et al.

(10) Patent No.: US 10,575,574 B1
(45) Date of Patent: Mar. 3, 2020

(54) BOTTLE OPENING GLOVE

(71) Applicants: Adam Toledo, Plymouth, MA (US); Jessica Toledo, Plymouth, MA (US)

(72) Inventors: Adam Toledo, Plymouth, MA (US); Jessica Toledo, Plymouth, MA (US)

( * ) Notice: Subject to any disclaimer, the term of this patent is extended or adjusted under 35 U.S.C. 154(b) by 199 days.

(21) Appl. No.: 15/868,468

(22) Filed: Jan. 11, 2018

(51) Int. Cl.
*A41D 19/00* (2006.01)
*B67B 7/16* (2006.01)
*B67B 7/04* (2006.01)

(52) U.S. Cl.
CPC ..... *A41D 19/0024* (2013.01); *B67B 7/04* (2013.01); *B67B 7/16* (2013.01); *A41D 2300/32* (2013.01)

(58) Field of Classification Search
CPC .. A41D 19/0024; A41D 2300/32; B67B 7/04; B67B 7/16
USPC ..... 81/3.09
See application file for complete search history.

(56) References Cited

U.S. PATENT DOCUMENTS 171,752 A * 1/1876 Witte ..... B67B 7/44 7/155
4,580,303 A * 4/1986 Henshaw ..... B67B 7/44 215/226
4,894,866 A 1/1990 Walker
5,133,233 A 7/1992 Erwin
5,276,922 A 1/1994 Floyd, Jr.
5,329,832 A * 7/1994 Tegethoff ..... B67B 7/403 81/177.3
8,281,437 B2 10/2012 Hunkele
8,925,423 B1 * 1/2015 Rotolo ..... B67B 7/16 7/151
D779,129 S 2/2017 Mathias
2006/0143784 A1 * 7/2006 Jonker ..... A41D 19/0027 2/160
2008/0010718 A1 1/2008 Richards
2009/0049956 A1 2/2009 Brennan
2010/0090966 A1 * 4/2010 Gregorio ..... A41D 19/0024 345/173
2013/0086730 A1 4/2013 Wilkening
2014/0033396 A1 2/2014 Hartfield

FOREIGN PATENT DOCUMENTS

WO 1994005173 A 3/1994

* cited by examiner

*Primary Examiner* — Hadi Shakeri

(57) ABSTRACT

The bottle-opening glove is a multipurpose tool. The bottle-opening glove is adapted for use with a container. Wherein the container is configured to contain a foodstuff or a beverage. The bottle-opening glove comprises a glove and a plurality of tools. The glove attaches the bottle-opening glove to the hand of a wearer. Each of the plurality of tools attaches to the glove. Each of the plurality of tools is a device that opens the container.

14 Claims, 4 Drawing Sheets

BOTTLE OPENING GLOVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of transporting, more specifically, a hand tool configured for use in opening a container.

The human hand is a grasping structure. The human hand of the left side of the body is a mirror image of the human hand of the right side of the body. The orientation is used to define the front side 211 of the hand. Specifically, the left hand and the right hand can only be overlaid on top of each other when the front side 211 of the left hand is touching the front side 211 of the right hand. The side of the hand opposite to the front side 211 is referred to as the rear side 212. The human hand is further defined with a thumb (first finger), index finger (second finger), middle finger (third finger), ring finger (fourth finger), and a little finger (fifth finger).

A glove 101 is an item of apparel that covers a hand. The glove 101 comprises five finger stalls into which the fingers of the hand are inserted. Each finger stall attaches to a trank 111. The trank 111 is the portion of the glove 101 that covers the palm of the hand. The front side 211 of the trank 111 is proximal to the front side 211 of the hand. The rear side 212 of the trank 111 is proximal to the rear side 212 of the hand. Typically: 1) the thumb is inserted into the first finger stall 201; 2) the index finger is inserted into the second finger stall 202; 3) the middle finger is inserted into the third finger stall 203; 4) the ring finger is inserted into the fourth finger stall 204; and, 5) the little finger is inserted into the fifth finger stall 205. The distal end 213 of each of the five finger stalls is the end of the finger stall that is distal from the trank 111.

SUMMARY OF INVENTION

The bottle-opening glove is a multipurpose tool. The bottle-opening glove is adapted for use with a container. Wherein the container is configured to contain a foodstuff or a beverage. The bottle-opening glove comprises a glove and a plurality of tools. The glove attaches the bottle-opening glove to the hand of a wearer. Each of the plurality of tools attaches to the glove. Each of the plurality of tools is a device that opens the container.

These together with additional objects, features and advantages of the bottle-opening glove will be readily apparent to those of ordinary skill in the art upon reading the following detailed description of the presently preferred, but nonetheless illustrative, embodiments when taken in conjunction with the accompanying drawings.

In this respect, before explaining the current embodiments of the bottle-opening glove in detail, it is to be understood that the bottle-opening glove is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bottle-opening glove.

It is therefore important that the claims be regarded as including such equivalent construction insofar as they do not depart from the spirit and scope of the bottle-opening glove. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
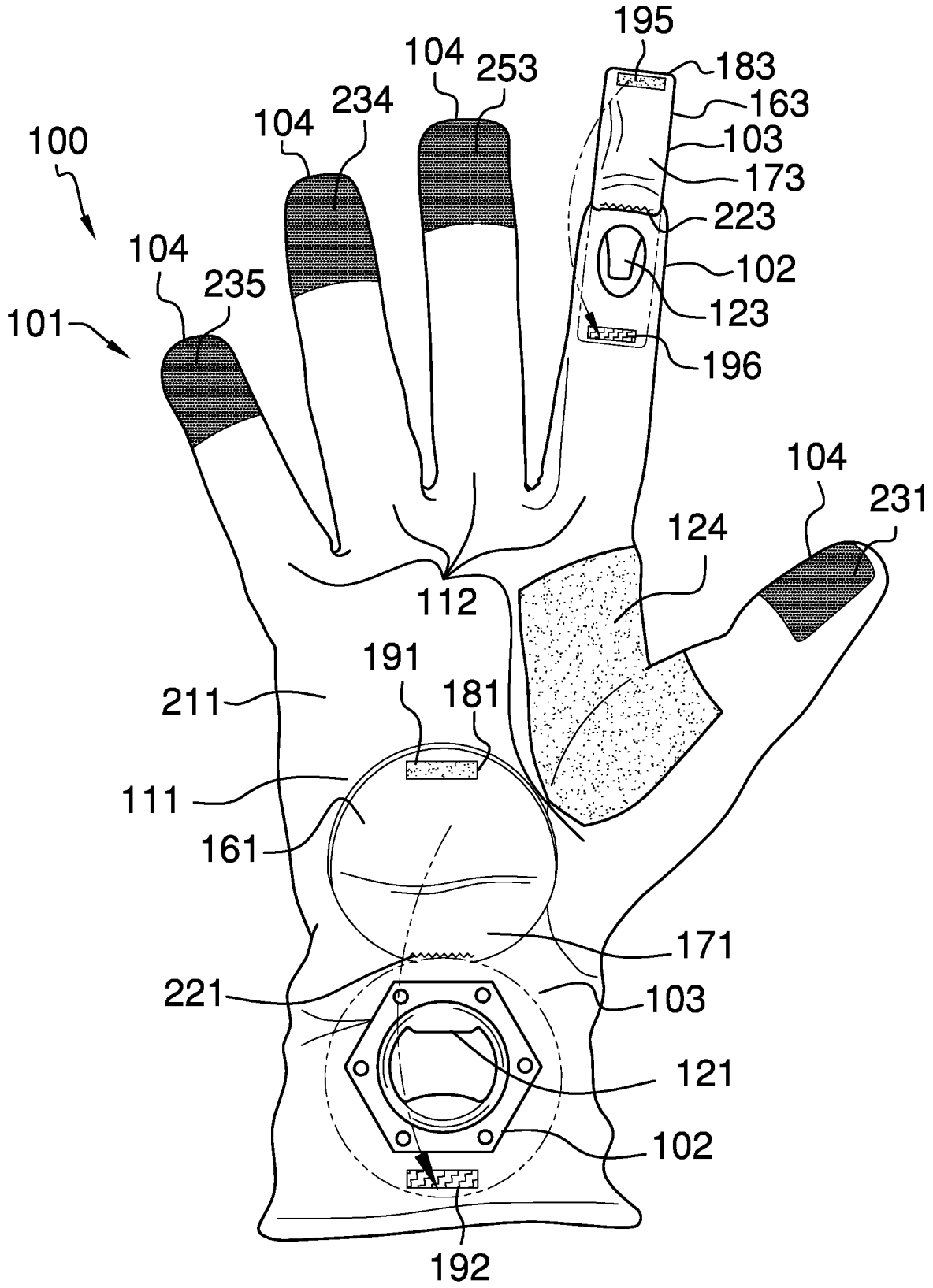
FIG. 1 is a front view of an embodiment of the disclosure.
Figure 2:
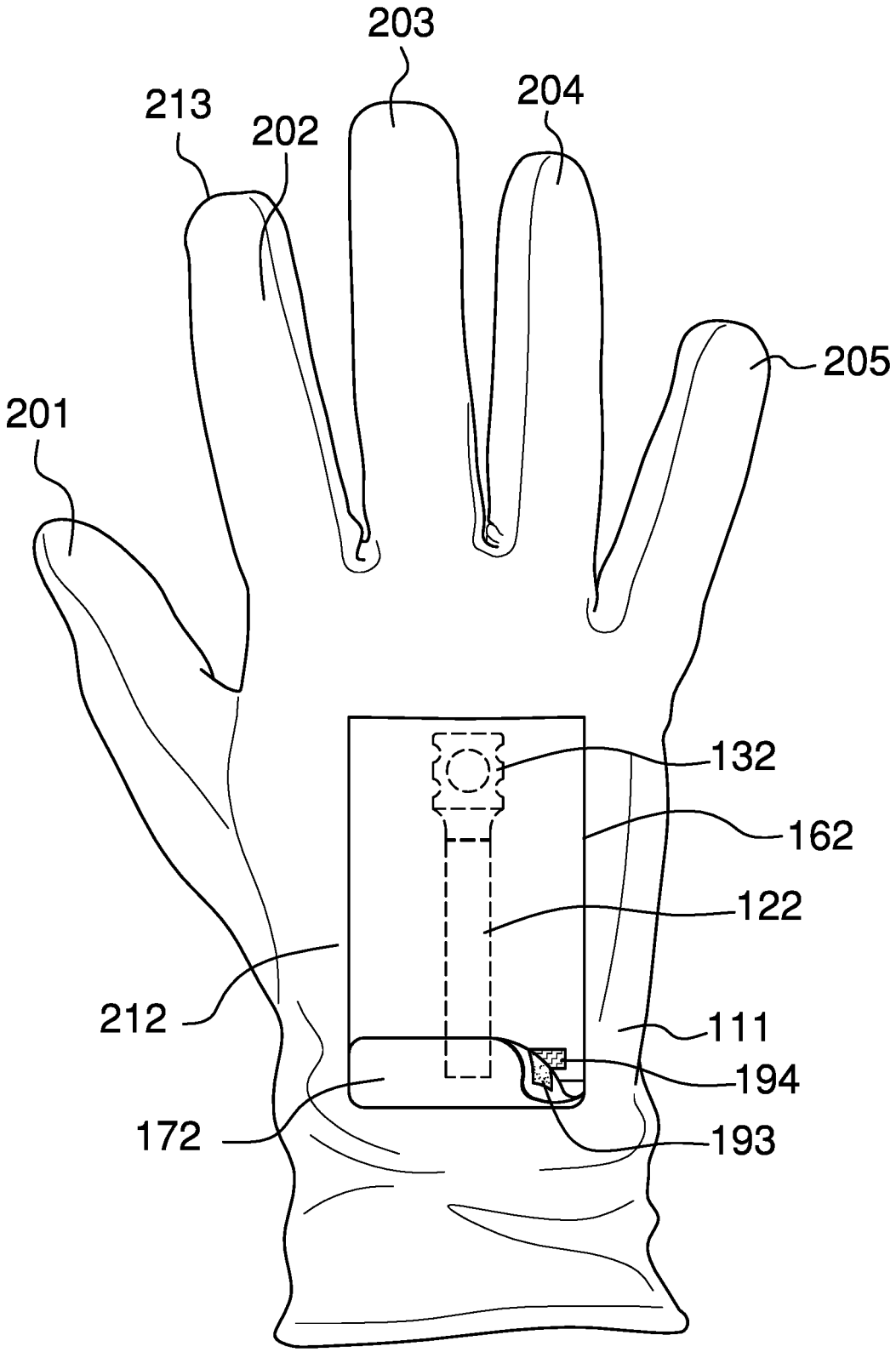
FIG. 2 is a side view of an embodiment of the disclosure.
Figure 3:
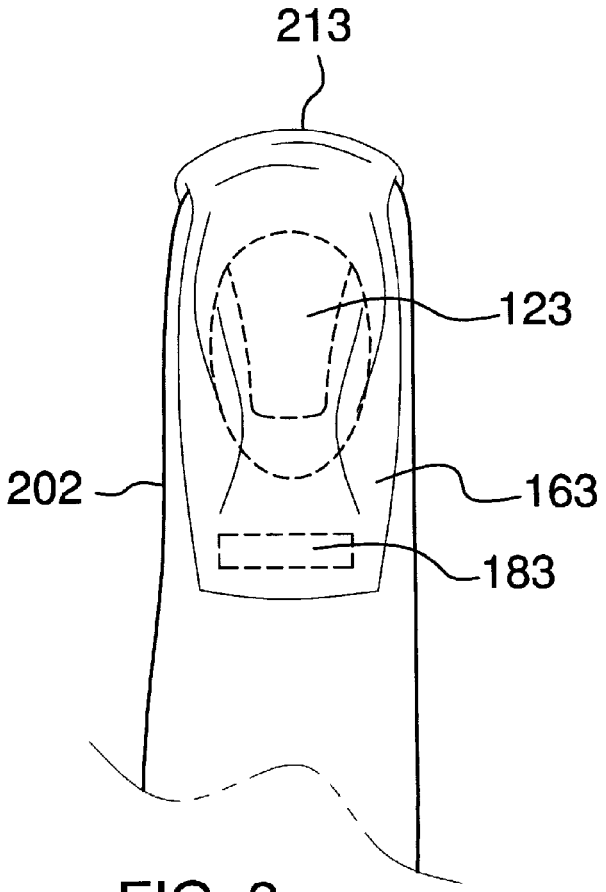
FIG. 3 is a detail view of an embodiment of the disclosure.
Figure 4:
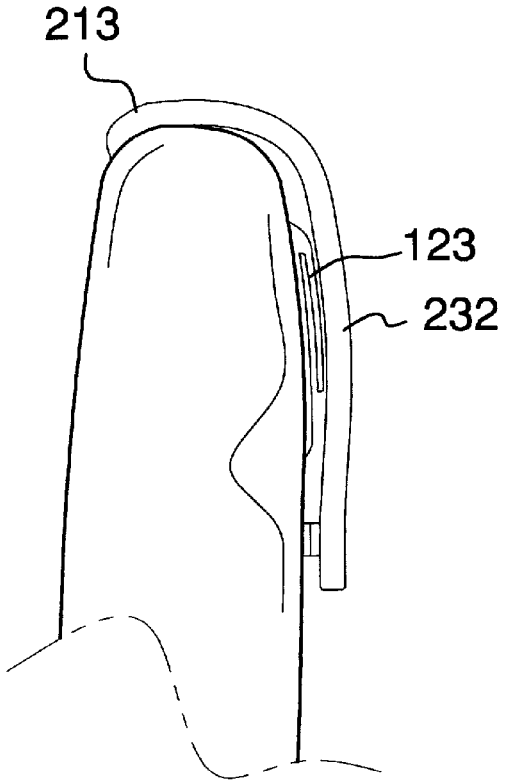
FIG. 4 is a detail view of an embodiment of the disclosure.
Figure 5:
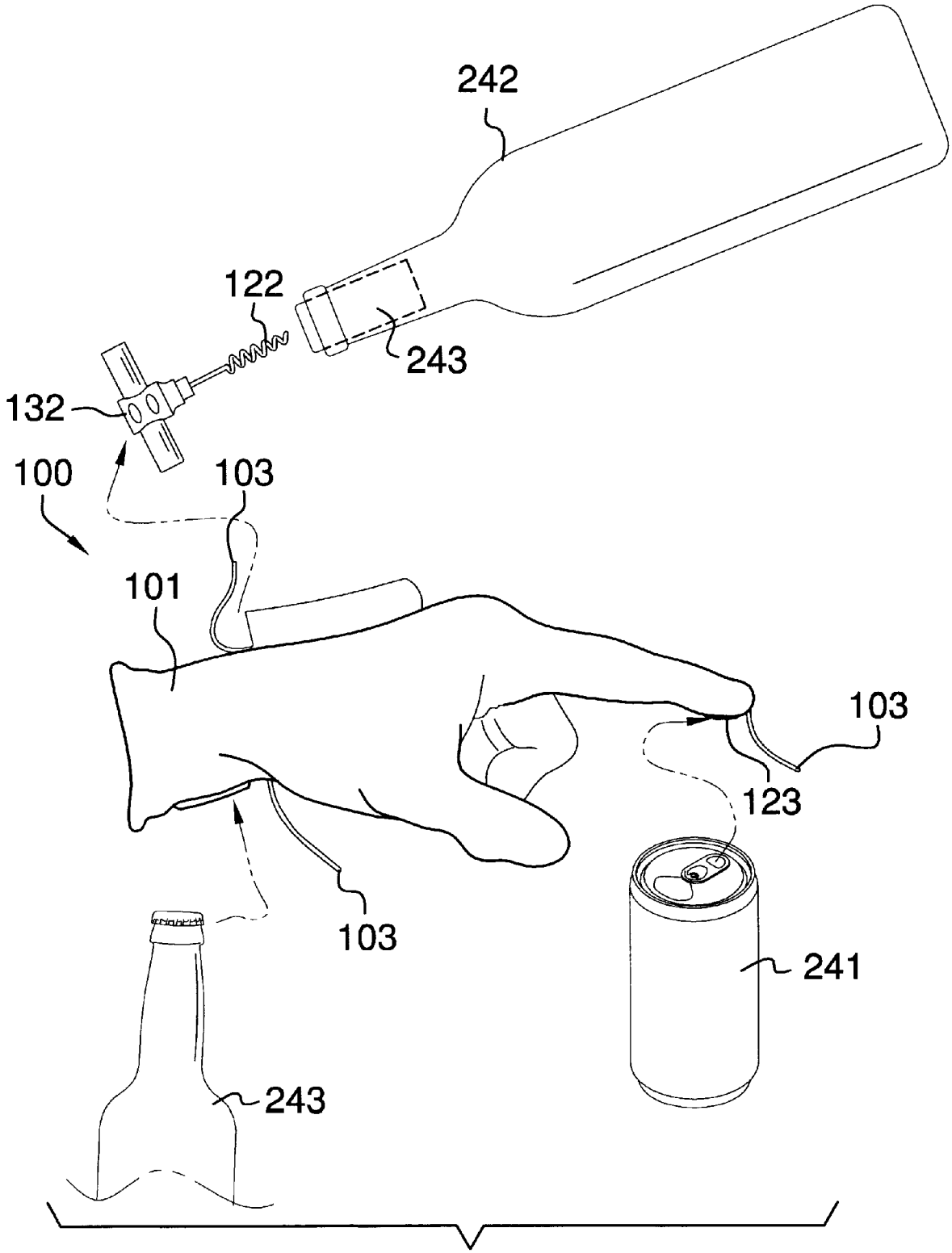
FIG. 5 is an in use view of an embodiment of the disclosure.

Detailed reference will now be made to one or more potential embodiments of the disclosure, which are illustrated in FIGS. 1 through 5.

The bottle-opening glove 100 (hereinafter invention) is a multipurpose tool. The invention 100 is adapted for use with a container. Wherein the container is selected from the group consisting of a canned foodstuff 241, a bottle 242, and a jar. Wherein the container is configured to contain a foodstuff or a beverage. The invention 100 comprises a glove 101 and a plurality of tools 102. The glove 101 attaches the invention 100 to the hand of a wearer. Each of the plurality of tools 102 attaches to the glove 101. Each of the plurality of tools 102 is a device that opens the container. In a second potential embodiment of the invention 100, the invention 100 further comprises a plurality of covers 103. Each of the plurality of covers 103 encloses a tool selected from the plurality of tools 102 when the selected tool is not in use. In a third potential embodiment of the disclosure, the invention 100 further comprises a plurality of conductive surfaces 104. Each of the plurality of conductive surfaces 104 is configured to work with a capacitive touch screen of a personal data device such that the personal data device may be used when the glove 101 is worn.

The glove 101 is a garment. The glove 101 is worn on the hand of the wearer. The glove 101 comprises a trank 111 and a plurality of finger stalls 112. The plurality of finger stalls 112 comprises a first finger stall 201, a second finger stall 202, a third finger stall 203, a fourth finger stall 204, and a fifth finger stall 205. The trank 111 is further defined with a front side 211 and a rear side 212 which are described in greater detail elsewhere in this disclosure. Each of the plurality of finger stalls 112 is further defined with a distal end 213 which is described in greater detail elsewhere in this disclosure. The trank 111 is discussed in greater detail elsewhere in this disclosure. The plurality of finger stalls 112 are discussed in greater detail elsewhere in this disclosure.

Each of the plurality of tools 102 is a device that is dedicated to opening a beverage container. Each of the plurality of tools 102 attaches to the glove 101 such that any tool selected from the plurality of tools 102 can be operated while the glove 101 is worn. The plurality of tools 102 comprises a bottle opener 121, a corkscrew 122, a can opener 123, and a jar opener 124.

The bottle opener 121 is a commercially available church key that is commonly used to remove the top off of a bottle 242. The bottle opener 121 further comprises a first hinge 131. The first hinge 131 is a commercially available hinge. The first hinge 131 attaches that bottle opener 121 to the trank 111 such that the bottle opener 121 will rotate into a position that accesses the cap of the bottle 242.

The corkscrew 122 is a commercially available helical structure that is commonly used to remove a cork 243 from a bottle 242. The corkscrew 122 further comprises a second hinge 132. The second hinge 132 is a commercially available hinge. The second hinge 132 attaches that corkscrew 122 to the trank 111 such that the corkscrew 122 will rotate from a position wherein the corkscrew 122 projects perpendicularly away from the surface of the trank 111 to a position where the corkscrew 122 lays in a parallel manner against the surface of the trank 111.

The can opener 123 is a commercially available leverage device that is commonly used to remove a pull tab of a canned foodstuff 241. The jar opener 124 is a commercially available non-skid material that removes a screw top lid from a container.

The plurality of tools 102 are attached to the glove 101 as described in this paragraph. The can opener 123 attaches to the front side 211 of the distal end 213 of the second finger stall 202. The jar opener 124 attaches to the purlicue at the front side 211 of the trank 111 using an adhesive. The first hinge 131 attaches the bottle opener 121 to the front side 211 of the trank 111 of the glove 101. The second hinge 132 attaches the corkscrew 122 to the rear side 212 of the trank 111 of the glove 101.

In a second potential embodiment of the disclosure, the invention 100 further comprises a plurality of covers 103. Each of the plurality of covers 103 is a textile based structure that is intended to cover a tool selected from the plurality of tools 102. Each of the plurality of covers 103 corresponds to a tool selected from the plurality of tools 102 in a one to one fashion. Specifically, each cover selected from the plurality of covers 103 is associated with a tool selected from the plurality of tools 102 but each tool contained within the plurality of tools 102 will not require a cover selected from the plurality of covers 103. The plurality of covers 103 comprises a first cover 161, a second cover 162, and a third cover 163.

The first cover 161 is associated with, and covers, the bottle opener 121 when the bottle opener 121 is not in use. The first cover 161 comprises a first flap 171, a first hook and loop fastener 181, and a first seam 221. The first flap 171 is a commercially available textile. In the first potential embodiment of the disclosure, the first flap 171 is cut in a rectangular shape. The first hook and loop fastener 181 is a commercially available hook and loop fastening device. The first hook and loop fastener 181 comprises a first hook or loop surface 191 and a second hook or loop surface 192. In the first potential embodiment of the disclosure, the first seam 221 is selected from the group consisting of a sewn seam and an adhesive based seam.

The second cover 162 is associated with, and covers, the corkscrew 122 when the corkscrew 122 is not in use. The second cover 162 comprises a second flap 172, a second hook and loop fastener 182, and a second seam 222. The second flap 172 is a commercially available textile. In the first potential embodiment of the disclosure, the second flap 172 is cut in a rectangular shape. The second hook and loop fastener 182 is a commercially available hook and loop fastening device. The second hook and loop fastener 182 comprises a third hook or loop surface 193 and a fourth hook or loop surface 194. In the first potential embodiment of the disclosure, the second seam 222 is selected from the group consisting of a sewn seam and an adhesive based seam.

The third cover 163 is associated with, and covers, the can opener 123 when the can opener 123 is not in use. The third cover 163 comprises a third flap 173, a third hook and loop fastener 183, and a third seam 223. The third flap 173 is a commercially available textile. In the first potential embodiment of the disclosure, the third flap 173 is cut in a rectangular shape. The third hook and loop fastener 183 is a commercially available hook and loop fastening device. The third hook and loop fastener 183 comprises a fifth hook or loop surface 195 and a sixth hook or loop surface 196. In the first potential embodiment of the disclosure, the third seam 223 is selected from the group consisting of a sewn seam and an adhesive based seam.

Hook and loop fasteners as well as hook and loop surfaces are discussed in greater detail elsewhere in this disclosure.

The covers are assembled as described in the following 3 paragraphs.

The first seam 221 attaches the first flap 171 of the first cover 161 to the front side 211 of the trank 111 such that the first cover 161 overlays on to the bottle opener 121. The second seam 222 attaches the second flap 172 of the second cover 162 to the rear side 212 of the trank 111 such that the second cover 162 overlays on to the corkscrew 122. The third seam 223 attaches the third flap 173 of the third cover 163 to the front side 211 of the distal end 213 of the second finger stall 202 such that the third cover 163 overlays on to the can opener 123.

The first hook and loop fastener 181 secures the first flap 171 to the front side 211 of the trank 111 when the bottle opener 121 is not in use. The second hook and loop fastener 182 secures the second flap 172 to the rear side 212 of the trank 111 when the corkscrew 122 is not in use. The third hook and loop fastener 183 secures the third flap 173 to the front side 211 of the distal end 213 of the second finger stall 202 when the can opener 123 is not in use.

The first hook or loop surface 191 attaches to the first flap 171. The second hook or loop surface 192 attaches to the front side 211 of the trank 111 such that the first hook or loop surface 191 can be attached to the second hook or loop surface 192. The third hook or loop surface 193 attaches to the second flap 172. The fourth hook or loop surface 194 attaches to the rear side 212 of the trank 111 such that the third hook or loop surface 193 can be attached to the fourth hook or loop surface 194. The fifth hook or loop surface 195 attaches to the third flap 173. The sixth hook or loop surface 196 attaches to the front side 211 of the distal end 213 of the second finger stall 202 such that the fifth hook or loop surface 195 can be attached to the sixth hook or loop surface 196.

In a third embodiment of the disclosure, the invention 100 further comprises a plurality of conductive surfaces 104. The plurality of conductive surfaces 104 is a sheeting that conducts electrical current. The plurality of conductive surfaces 104 the conductive nature of each of the plurality of conductive surfaces 104 allows the user to operate a capacitive touch screen while wearing the glove 101. Capacitive touch screens are commonly associated with personal data devices. The plurality of conductive surfaces 104 comprises a first conductive surface 231, a second conductive surface 232, a third conductive surface 233, a fourth conductive surface 234, and a fifth conductive surface 235.

The first conductive surface 231 attaches to the front side 211 of the distal end 213 of the first finger stall 201 using an adhesive. The second conductive surface 232 attaches to the third flap 173 of the third cover 163 such that the second conductive surface 232 is on the surface of the third flap 173 that is distal from the can opener 123. The second conductive surface 232 attaches using an adhesive. The third conductive surface 233 attaches to the front side 211 of the distal end 213 of the third finger stall 203 using an adhesive. The fourth conductive surface 234 attaches to the front side 211 of the distal end 213 of the fourth finger stall 204 using an adhesive. The fifth conductive surface 235 attaches to the front side 211 of the distal end 213 of the fifth finger stall 205 using an adhesive.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Beverage: As used in this disclosure, a beverage is a liquid that is intended for consumption by a person.

Bottle: As used in this disclosure, a bottle is a container used for the storage of fluids. Access to the interior of a bottle is gained through the neck of the bottle. The neck is an elongated tube that forms an aperture through which fluids can be introduced and removed from the bottle.

Cork: As used in this disclosure, a cork refers to a cylindrically shaped structure that is formed from an elastomeric material. Corks are commonly used to seal contents within a bottle.

Correspond: As used in this disclosure, the term correspond means that a first object is in some manner linked to a second object in a one to one relationship.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Elastic: As used in this disclosure, an elastic is a material or object that deforms when a force is applied to it and that is able to return to its relaxed shape after the force is removed. A material that exhibits these qualities is also referred to as an elastomeric material.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

Finger Stall: As used in this disclosure, a finger stall refers to: 1) the roughly cylindrical structure associated with a glove into which a finger may be inserted; or, 2) a roughly cylindrical cover, commonly referred to as a finger cot, that is placed directly over a finger to cover the finger. A finger stall is also referred to as a fourchete.

Foodstuff: As used in this disclosure, a foodstuff refers to an edible material that is used as food.

Glove: As used in this disclosure, a glove is an item of apparel that covers a hand. The glove comprises five finger stalls into which the fingers of the hand are inserted. A glove is further defined with a palm side and a back side. The palm side is proximal to the palm of the hand. The back side is distal from the palm side.

Hinge: As used in this disclosure, a hinge is a device that permits the turning, rotating, or pivoting of a first object relative to a second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Lever: As used in this disclosure, a lever is a simple machine that comprises a shaft that rotates around a fulcrum or pivot point.

Non-Skid Material: As used in this disclosure, a non-skid material is a commercially available product that can be applied to an object such that the object is inhibited from sliding along the surface upon which the object is resting. Non-skid materials are often, but not always, adhesive or abrasive materials.

One to One: When used in this disclosure, a one to one relationship means that a first element selected from first set is in some manner connected to only one element of a second set. A one to one correspondence means that the one to one relationship exists both from the first set the second set and from the second set to the first set. A one to one fashion means that the one to one relationship exists in only one direction.

Personal Data Device: As used in this disclosure, a personal data device is a handheld device that is used for managing personal information and communication. Examples of personal data device include, but are not limited to, cellular phones, tablets and smart phones.

Pivot: As used in this disclosure, a pivot is a rod or shaft around which an object rotates or swings.

Purlicue: As used in this disclosure, the purlicue refers to the space between the thumb and the index finger of a hand.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as a textile, a plastic, or a metal foil, in the form of a thin flexible layer or layers.

Textile: As used in this disclosure, a textile is a material that is woven, knitted, braided or felted. Synonyms in common usage for this definition include fabric and cloth.

Tool: As used in this disclosure, a tool is a device, an apparatus, or an instrument that is used to carry out an activity, operation, or procedure.

Trank: As used in this disclosure, the trank refers to the portion of a glove that covers the palm and back of the hand.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hand tool comprising:

wherein the hand tool comprises a glove and a plurality of tools;

wherein the glove attaches the hand tool to a hand of a wearer;

wherein each of the plurality of tools attach to the glove;

wherein the hand tool is configured for use with a container;

wherein each of the plurality of tools is a device that opens the container;

wherein the container is configured to contain a foodstuff or a beverage;

wherein the container is selected from the group consisting of a can, a jar, and a bottle;

wherein the glove is a garment;

wherein the glove comprises a trank and a plurality of finger stalls;

wherein the plurality of finger stalls are attached to the trank;

wherein the plurality of finger stalls comprises a first finger stall, a second finger stall, a third finger stall, a fourth finger stall, and a fifth finger stall;

wherein the trank is further defined with a front side and a rear side;

wherein each of the plurality of finger stalls is further defined with a distal end;

wherein the plurality of tools comprises a can opener, a corkscrew, a bottle opener, and a jar opener;

wherein the bottle opener, the corkscrew and the jar opener are attached to the trank;

wherein the can opener is attached to a finger stall selected from the plurality of finger stalls;

wherein the can opener attaches to the front side of the distal end of the second finger stall;

wherein the jar opener attaches to the purlicue at the front side of the trank using an adhesive;

wherein the bottle opener attaches to the front side of the trank of the glove;

wherein the hand tool further comprises a plurality of covers;

wherein each of the plurality of covers attaches to the glove;

wherein each of the plurality of covers encloses a tool selected from the plurality of tools;

wherein each of the plurality of covers corresponds to a tool selected from the plurality of tools in a one to one fashion;

wherein the plurality of covers comprises a first cover;

wherein the first cover covers the bottle opener;

wherein the first cover comprises a first flap, a first hook and loop fastener, and a first seam;

wherein the first flap is a textile;

wherein the first flap is cut in a rectangular shape;

wherein the first hook and loop fastener is a hook and loop fastening device;

wherein the first hook and loop fastener comprises a first hook/loop surface and a second hook/loop surface;

wherein the first seam is selected from the group consisting of a sewn seam and an adhesive based seam.

2. The hand tool according to claim 1 wherein each of the plurality of tools attaches to the glove such that any tool selected from the plurality of tools can be operated while the glove is worn.

3. The hand tool according to claim 2 wherein the bottle opener is a church key;

wherein the bottle opener is configured for use with a bottle;

wherein the bottle opener opens the bottle.

4. The hand tool according to claim 2 wherein the corkscrew is a helical structure;

wherein the corkscrew is configured for use with a bottle;

wherein the corkscrew removes a cork from the bottle;

wherein the corkscrew further comprises a primary hinge.

5. The hand tool according to claim 4 wherein the bottle opener is a blade;

wherein the bottle opener opens the pull tab of a can.

6. The hand tool according to claim 5
wherein the jar opener is a non-skid material;
wherein the jar opener removes a screw top lid from a jar.
7. The hand tool according to claim 6
wherein the hand tool further comprises a plurality of conductive surfaces;
wherein the plurality of conductive surfaces is a sheeting that conducts electrical current;
wherein each of the plurality of conductive surfaces attaches to the glove.
8. The hand tool according to claim 7
wherein the plurality of conductive surfaces comprises a first conductive surface, a second conductive surface, a third conductive surface, a fourth conductive surface, and a fifth conductive surface;
wherein the first conductive surface attaches to the front side of the distal end of the first finger stall using an adhesive;
wherein the second conductive surface attaches to a third flap of the third cover such that the second conductive surface is on the surface of the third flap that is distal from the bottle opener;
wherein the second conductive surface attaches using an adhesive;
wherein the third conductive surface attaches to the front side of the distal end of the third finger stall using an adhesive;
wherein the fourth conductive surface attaches to the front side of the distal end of the fourth finger stall using an adhesive;
wherein the fifth conductive surface attaches to the front side of the distal end of the fifth finger stall using an adhesive.
9. The hand tool according to claim 1
wherein the plurality of covers further comprises a second cover;
wherein the second cover covers the corkscrew;
wherein the second cover comprises a second flap, a second hook and loop fastener, and a second seam;
wherein the second flap is a textile;
wherein the second flap is cut in a rectangular shape;
wherein the second hook and loop fastener is a hook and loop fastening device;
wherein the second hook and loop fastener comprises a third hook/loop surface and a fourth hook/loop surface;
wherein the second seam is selected from the group consisting of a sewn seam and an adhesive based seam.
10. The hand tool according to claim 9
wherein the plurality of covers further comprises a third cover;
wherein the third cover covers the can opener;
wherein the third cover comprises a third flap, a third hook and loop fastener, and a third seam;
wherein the third flap is a textile;
wherein the third flap is cut in a rectangular shape;
wherein the third hook and loop fastener is a hook and loop fastening device;
wherein the third hook and loop fastener comprises a fifth hook/loop surface and a sixth hook/loop surface;
wherein the third seam is selected from the group consisting of a sewn seam and an adhesive based seam.
11. The hand tool according to claim 10
wherein the first seam attaches the first flap of the first cover to the front side of the trank such that the first cover overlays on to the bottle opener;
wherein the second seam attaches the second flap of the second cover to the rear side of the trank such that the second cover overlays on to the corkscrew;
wherein the third seam attaches the third flap of the third cover to the front side of the distal end of the second finger stall such that the third cover overlays on to the can opener;
wherein the first hook and loop fastener secures the first flap to the front side of the trank;
wherein the second hook and loop fastener secures the second flap to the rear side of the trank;
wherein the third hook and loop fastener secures the third flap to the front side of the distal end of the second finger stall;
wherein the first hook/loop surface attaches to the first flap;
wherein the second hook/loop surface attaches to the front side of the trank such that the first hook/loop surface can be attached to the second hook/loop surface;
wherein the third hook/loop surface attaches to the second flap;
wherein the fourth hook/loop surface attaches to the rear side of the trank such that the third hook/loop surface can be attached to the fourth hook/loop surface;
wherein the fifth hook/loop surface attaches to the third flap;
wherein the sixth hook/loop surface attaches to the front side of the distal end of the second finger stall such that the fifth hook/loop surface can be attached to the sixth hook/loop surface.
12. The hand tool according to claim 11
wherein the hand tool further comprises a plurality of conductive surfaces;
wherein each of the plurality of conductive surfaces is configured to work with a capacitive touch screen;
wherein each of the plurality of conductive surfaces attaches to the glove.
13. The hand tool according to claim 12
wherein the plurality of conductive surfaces is a sheeting that conducts electrical current.
14. The hand tool according to claim 13
wherein the plurality of conductive surfaces comprises a first conductive surface, a second conductive surface, a third conductive surface, a fourth conductive surface, and a fifth conductive surface;
wherein the first conductive surface attaches to the front side of the distal end of the first finger stall using an adhesive;
wherein the second conductive surface attaches to the third flap of the third cover such that the second conductive surface is on the surface of the third flap that is distal from the bottle opener;
wherein the second conductive surface attaches using an adhesive;
wherein the third conductive surface attaches to the front side of the distal end of the third finger stall using an adhesive;
wherein the fourth conductive surface attaches to the front side of the distal end of the fourth finger stall using an adhesive;
wherein the fifth conductive surface attaches to the front side of the distal end of the fifth finger stall using an adhesive.

* * * * *